US006095497A

United States Patent [19]

Chen

[11] Patent Number: 6,095,497

[45] Date of Patent: Aug. 1, 2000

[54] CRACK-PROOF STRUCTURE OF THE NAIL PULLING GROOVE OF A HAMMER

[76] Inventor: John Chen, No. 14, Alley 6, Lane 17, Sec. 3, Chung Yang Rd., Lung Ching Hsiang, Taichung Hsien, Taiwan

[21] Appl. No.: 09/349,120

[22] Filed: Jul. 8, 1999

[51] Int. Cl.[7] ..... B25C 11/00

[52] U.S. Cl. ..... 254/19; 254/26 R; 254/8; 81/22

[58] Field of Search ..... 254/25, 19, 20, 254/26 R, 26 E; 81/22, 20

[56] References Cited

U.S. PATENT DOCUMENTS 368,516 8/1887 Cooper et al. ..... 254/19

429,508 6/1890 Crane ..... 254/19

6,016,722 1/2000 Gierer et al. ..... 81/22

*Primary Examiner*—David A. Scherbel

*Assistant Examiner*—Lee Wilson

*Attorney, Agent, or Firm*—Bacon & Thomas, PLLC

[57] ABSTRACT

A crack-proof structure of the nail pulling groove of a hammer used in a hammer with a nail pulling groove at rear end thereof is disclosed, a V shape nail pulling groove is formed on the meddle portion of the distal end. The lower portion of the nail pulling groove of the hammer has a penetrating round hole. A cylindrical rubber plug is inserted in the round hole for preventing concentration of stress forces or dispersing stress force. Thereby, the inner stress due to the impact of the hammer is absorbed by the rubber plug. Therefore, the nail pulling groove is prevented to crack as the hammer serves to knock a nail or an object.

2 Claims, 5 Drawing Sheets

CRACK-PROOF STRUCTURE OF THE NAIL PULLING GROOVE OF A HAMMER

BACKGROUND OF THE INVENTION

1. Field of the Invention

The present invention relates to a crack-proof structure of the nail pulling groove of a hammer used in a hammer with a nail pulling groove at rear end thereof. The lower portion of the nail pulling groove of the hammer has a penetrating round hole. A cylindrical rubber plug is inserted in the round hole. Therefore, the nail pulling groove is prevented to crack as the hammer serves to knock a nail or an object.

2. Description of the Prior Art

In the prior art hammer with a nail pulling groove, the distal end of a hammer has a flat shape, and a V shape nail pulling groove is formed therein for forming nail pulling hooks on two sides of the nail pulling groove. Thereby, as a nail is pulled by the hammer, the nail pulling groove can be used to enclose the periphery of the nail, and the hooks will hook the lower rim of the nut portion of the nail. When the handle of the hammer is pulled by the user, the nail will be pulled up so as to separate with the fixing object. Thus, the prior art hammer with a nail pulling groove is convenient in using.

The nail pulling groove is formed by two nail pulling hooks with a V shape. When a user use the hammer to knock a nail or an object, the nail pulling hooks are possibly effected due to a large impact force. Thus, stress is concentrated in the adjacent corners. Namely, the inner stress is concentrated in the bottom of the V shape nail pulling groove. Thus, the bottom of the nail pulling groove is easily cracked due to stress forces. Especially, when the inner stress mixed with the reverse impact force applies to the nail pulling groove, a large impact will induced. Moreover, the function of a hammer to pull a nail is effected, and the lifetime of the hammer is reduced greatly.

SUMMARY OF THE INVENTION

Accordingly, the object of the present invention is to provide a crack-proof structure of the nail pulling groove of a hammer used in a hammer with a nail pulling groove at rear end thereof. The lower portion of the nail pulling groove of the hammer has a penetrating round hole. A cylindrical rubber plug is inserted in the round hole. Thereby, the inner stress due to the impact of the hammer is absorbed by the rubber plug. Therefore, the nail pulling groove is prevented to crack as the hammer serves to knock a nail or an object.

The present invention will be better understood and its numerous objects and advantages will become apparent to those skilled in the art by referencing to the following drawings in which:

DETAILED DESCRIPTION OF THE PREFERRED EMBODIMENT

Figure 1:
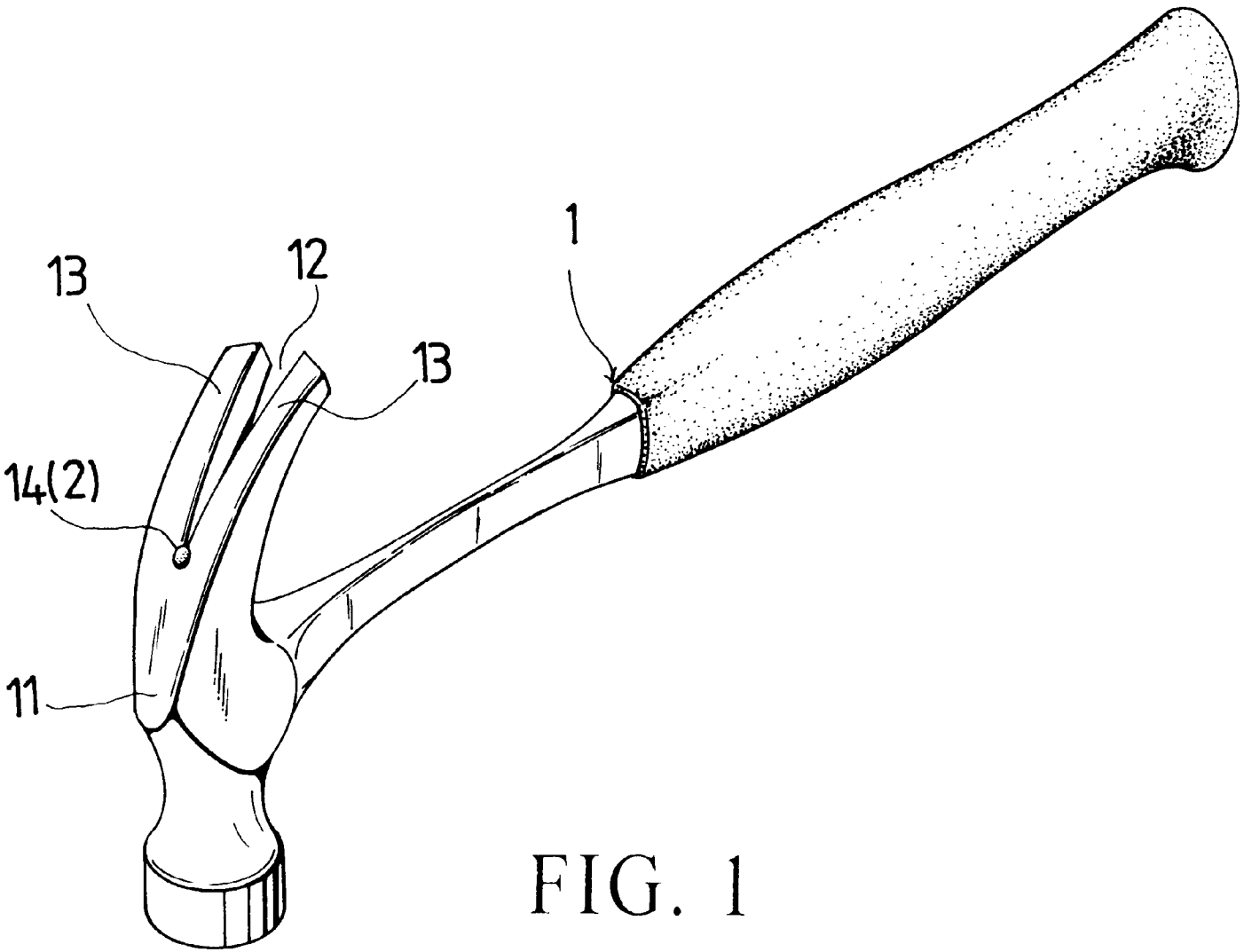
FIG. 1 is a perspective view of the hammer according to the present invention.

With reference to FIG. 1, the crack-proof structure of the nail pulling groove of a hammer according to the present invention is illustrated, which serves to improve a hammer with a nail pulling groove at rear end thereof.

Figure 2:
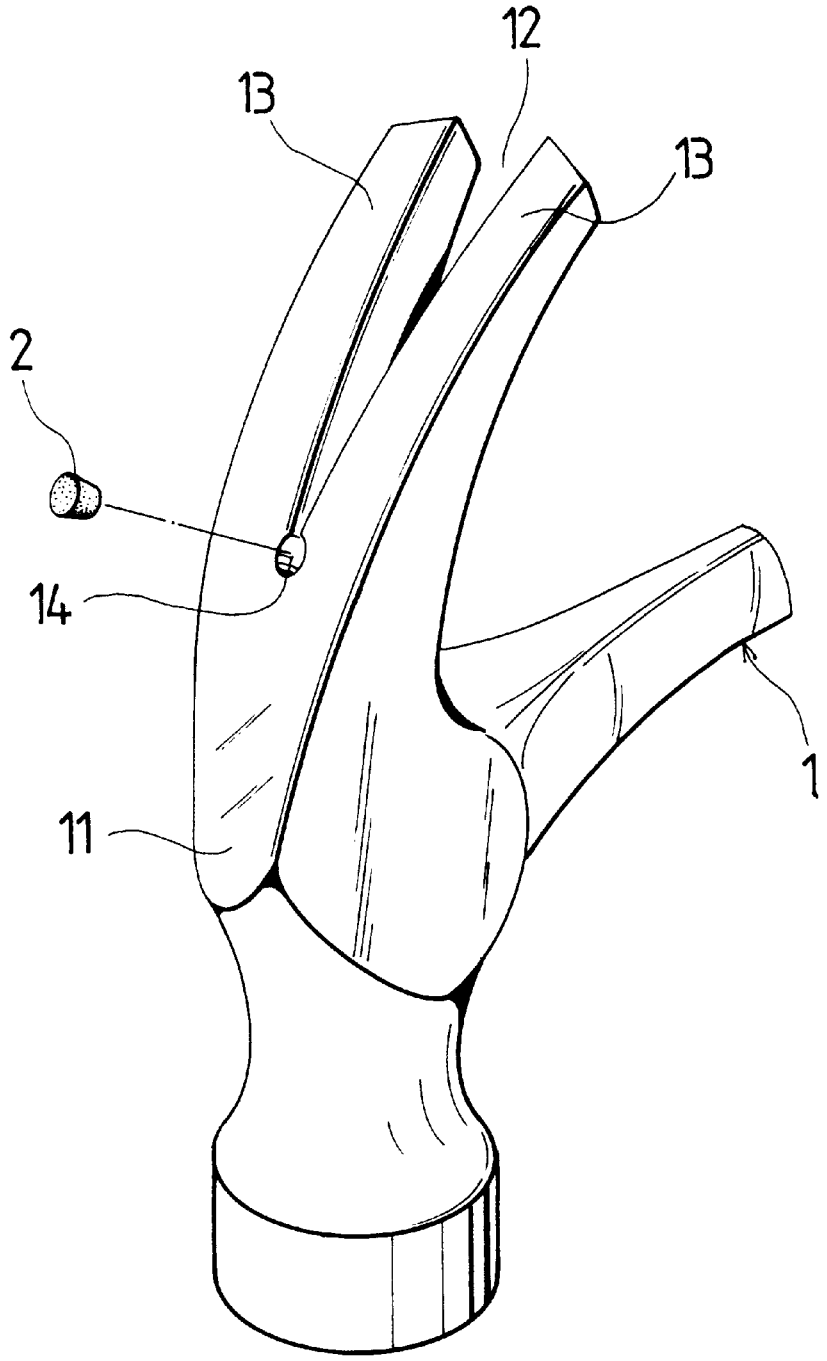
FIG. 2 is an exploded perspective view of the round hole and rubber plug of the present invention.
Figure 4:
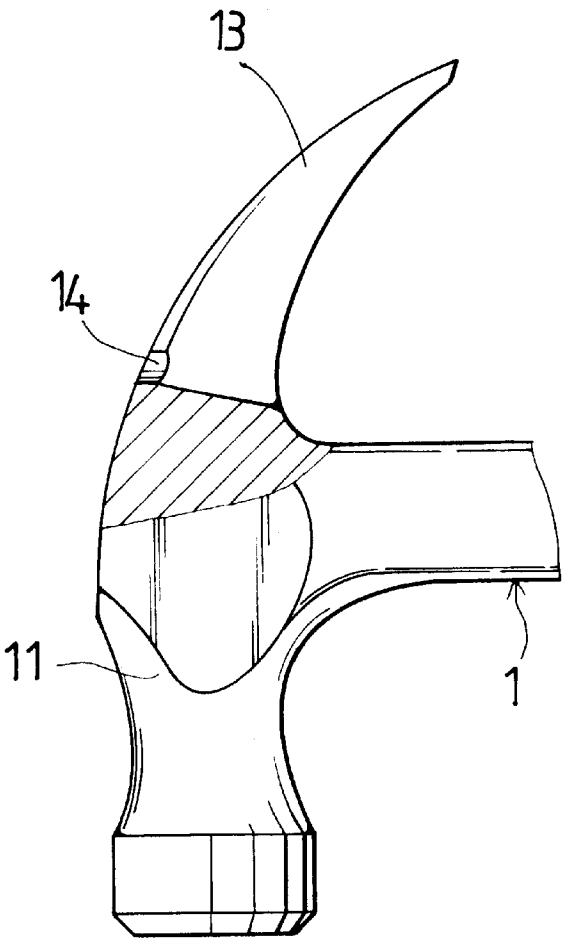
FIG. 4 is a cross sectional view schematically showing the lateral view of the round hole according to the present invention.
Figure 3:
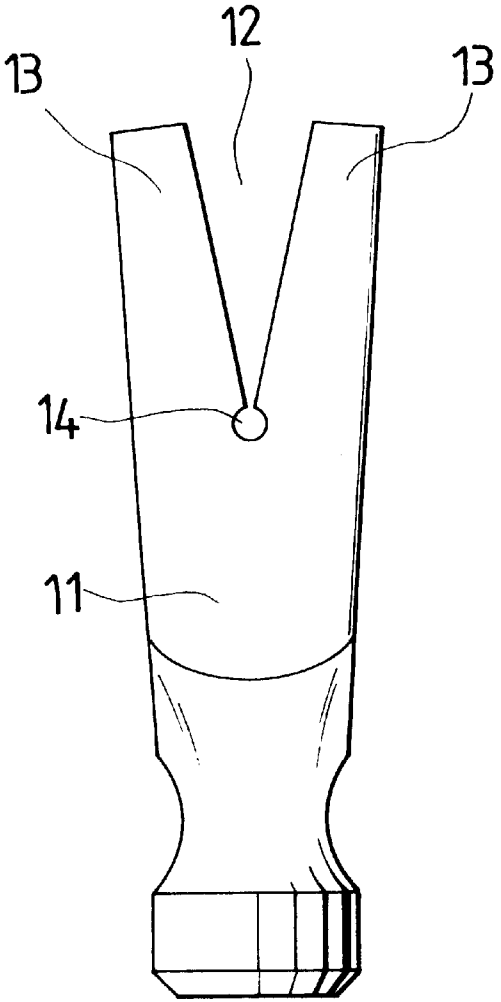
FIG. 3 shows the position of the round hole according to the present invention.

In the hammer 1, the distal end of the head 11 thereof has a flat cambered shape. A V shape nail pulling groove 12 is formed on the meddle portion of the distal end. Each of the two sides of the nail pulling groove 12 has a respective nailing pulling hook 13. The lower portion of the V shape nail pulling groove 12 has a penetrating round hole 14. A part of the edge of the round hole 14 is adjacent to the lower portion of the nail pulling groove 12 (as shown in FIG. 3 and 4). By the round hole 14, the stress within the nail pulling groove 12 can be removed. A cylindrical rubber plug 2 is inserted in the round hole 14 (as shown in FIG. 2).

By above hammer 1 with a nail pulling groove 12 having a round hole 14 and a rubber plug 2 at the bottom thereof, when the hammer serve to knock a nail or other object, the impact or inner stress from the knock can be dispersed by the round hole 14 without concentrating in one point. Namely, the rubber plug absorbed the vibrating force. Thus, the crack due to the inner stress or a reverse impact is absorbed and the lifetime of the hammer is increased.

Figure 5:
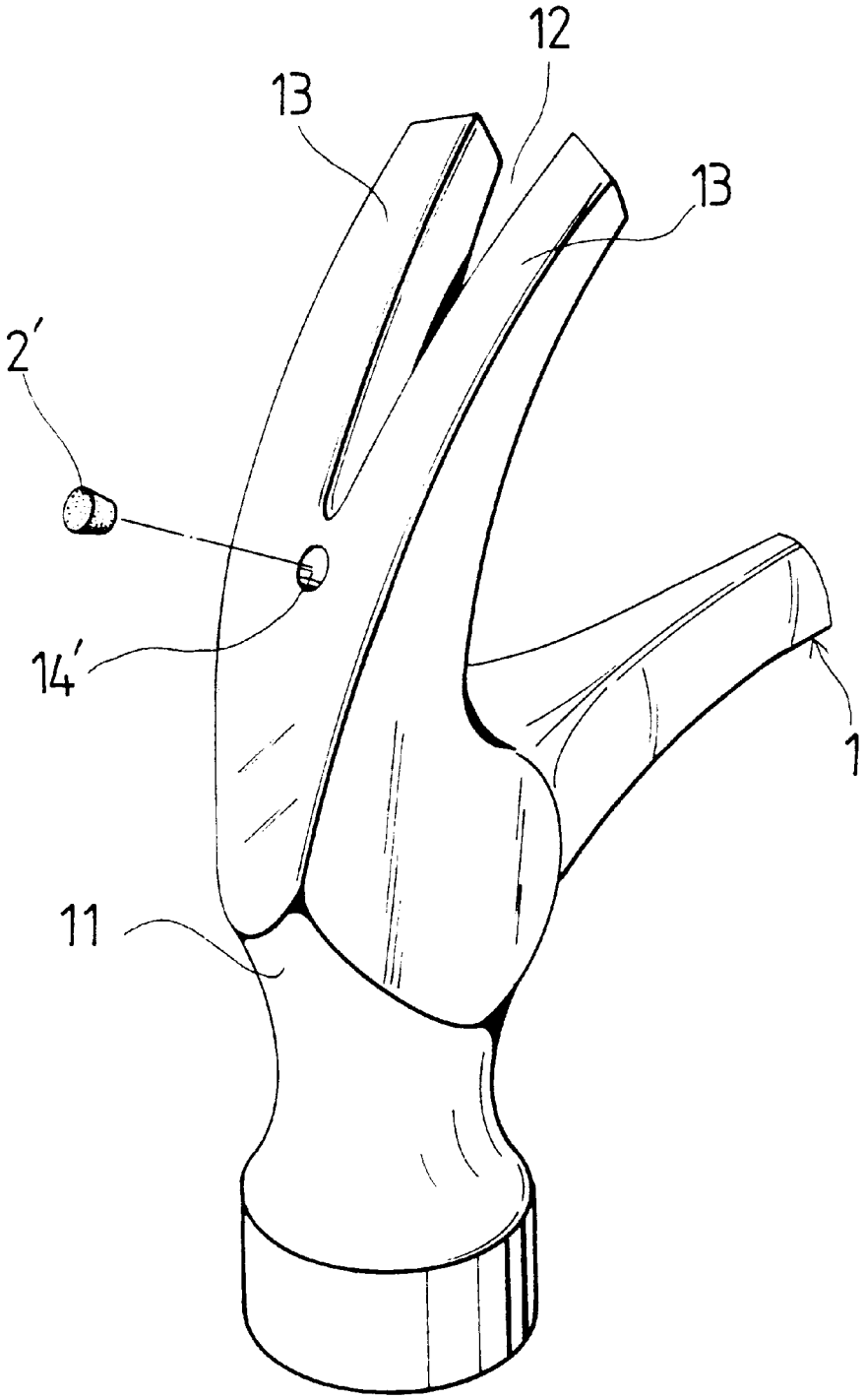
FIG. 5 is an exploded perspective view in another embodiment of the present invention.
Figure 7:
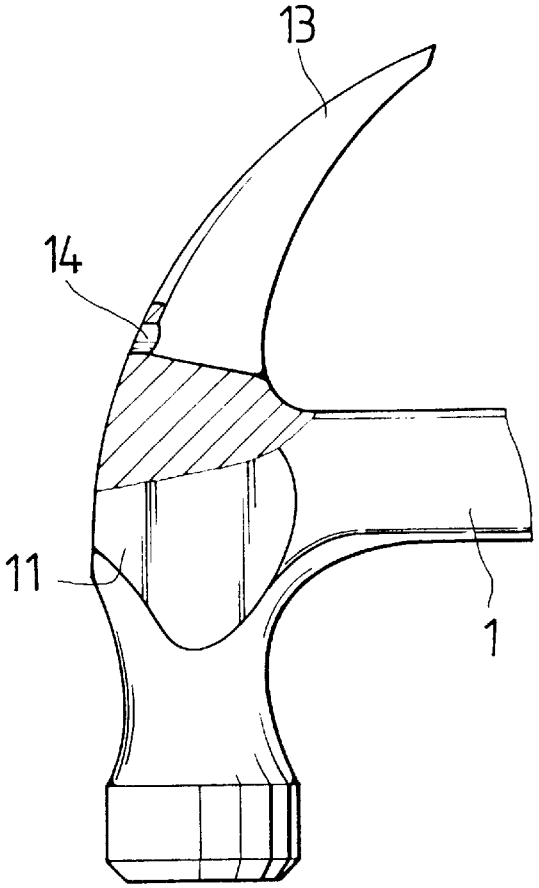
FIG. 7 is a schematic cross sectional view showing the another embodiment according to the present invention.
Figure 6:
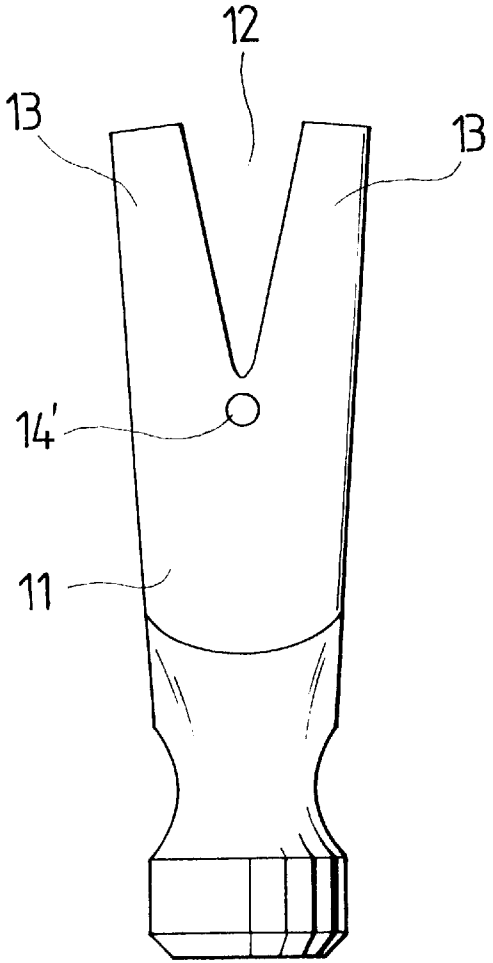
FIG. 6 is cross sectional view showing the round hole in another embodiment of the present invention.

Moreover, as shown in FIG. 5, a position of the round hole 14' may retain a proper length with the bottom of the nail pulling groove 12 so that the round hole 14' is not adjacent to the lower portion of the nail pulling groove 12 (as shown in FIGS. 6 and 7), and a rubber plug 2' is inserted therewithin. Accordingly, when the hammer serves to knock a nail or an object, when the inner stress or impact from the knock is too large to be suffered by the nail pulling groove, a crack will be formed from the lower rim of the nail pulling groove 12 to the round hole 14'. While as the crack is extended to the round hole 14', the inner stress or reverse impact will be absorbed by the round hole 14' and the rubber plug 2'. Therefore, the crack is prevented to enlarge continuously. As a result, the lifetime of the hammer is prolonged.

Although the present invention has been described using specified embodiment, the examples are meant to be illustrative and not restrictive. It is clear that many other variations would be possible without departing from the basic approach, demonstrated in the present invention.

What is claimed is:

1. A crack-proof structure of the nail pulling groove of a hammer used in a hammer with a nail pulling groove at rear end thereof, a V shape nail pulling groove is formed on the meddle portion of the distal end, characterized in that:

a lower portion of the nail pulling groove of the hammer has a penetrating round hole, a part of the edge of the round hole is adjacent to the lower rim of the nail pulling groove, a cylindrical rubber plug is inserted in the round hole, thereby, the inner stress due to the impact of the hammer is absorbed by the rubber plug, therefore, the nail pulling groove is prevented to crack as the hammer serves to knock a nail or an object.

2. The crack-proof structure of the nail pulling groove of a hammer as claimed in claim 1, wherein the position the round hole retains a proper length with the bottom of the nail pulling groove so that the round hole is not adjacent to the lower portion of the nail pulling groove, and a rubber plug is inserted therewithin.

* * * * *